US006109736A

United States Patent [19]

Miyata et al.

[11] Patent Number: 6,109,736

[45] Date of Patent: Aug. 29, 2000

[54] INK JET RECORDING HEAD CONTAINING A SEALED FLUID FOR PROTECTING A PIEZOELECTRIC VIBRATOR

[75] Inventors: Yoshinao Miyata; Masato Shimada; Kazuhiko Fujimori; Koji Sumi; Shiro Yazaki; Soichi Moriya; Tsutomu Hashizume, all of Nagano, Japan

[73] Assignee: Seiko Epson Corporation, Tokyo, Japan

[21] Appl. No.: 09/033,086

[22] Filed: Mar. 2, 1998

[30] Foreign Application Priority Data

Mar. 3, 1997 [JP] Japan ..... 9-063888
Feb. 12, 1998 [JP] Japan ..... 10-029414

[51] Int. Cl.[7] ..... B41J 2/045

[52] U.S. Cl. ..... 347/68

[58] Field of Search ..... 347/68, 70, 71, 347/72; 29/890.1

[56] References Cited

U.S. PATENT DOCUMENTS 5,754,205 5/1998 Miyata et al. ..... 347/70
5,861,902 1/1999 Beerling ..... 347/63
5,912,684 6/1999 Fujii et al. ..... 347/68 X

FOREIGN PATENT DOCUMENTS 0 580 283 1/1994 European Pat. Off. ..... B41J 2/16
0 616 890 9/1994 European Pat. Off. ..... B41J 2/045
0 738 599 10/1996 European Pat. Off. ..... B41J 2/16
0 759 362 2/1997 European Pat. Off. ..... B41J 2/175
7-125197 5/1995 Japan ..... B41J 2/045

*Primary Examiner*—Fred L. Braun
*Attorney, Agent, or Firm*—Sughrue, Mion, Zinn, Macpeak & Seas, PLLC

[57] ABSTRACT

An ink jet recording head is provided with a piezoelectric vibrator. The piezoelectric vibrator includes a diaphragm and a piezoelectric active part. The diaphragm includes a pressure generating chamber communicating with a nozzle aperture, at least the upper surface of which acts as a lower electrode. The piezoelectric active part includes a piezoelectric film formed on the surface of the diaphragm and an upper electrode formed on the surface of the piezoelectric film, formed in an area opposite to the pressure generating chamber. A cap member is bonded on one side of the piezoelectric film for sealing a space with a holder to the extent that the motion is secured. The piezoelectric active part is cut off from the outside of the head by sealing dry fluid in the space of the cap member.

21 Claims, 8 Drawing Sheets

INK JET RECORDING HEAD CONTAINING A SEALED FLUID FOR PROTECTING A PIEZOELECTRIC VIBRATOR

BACKGROUND OF THE INVENTION

1. Technical Field of the Invention

The present invention relates to an ink jet recording head for emitting an ink droplet from a nozzle aperture. More particularly, the present invention is directed to an ink jet recording head which emits an ink droplet by flexural oscillation according to an actuator, so that a part of a pressure generating chamber, which communicates with a nozzle aperture, expands and contracts.

2. Description of the Prior Art

Conventionally, there are two types of ink jet recording heads available: a piezoelectric vibrator type which mechanically deforms a pressure generating chamber to pressurize the ink and a bubble jet type which provides an exothermic element in a pressure generating chamber to pressurize the ink by the pressure of bubbles generated by the head of the exothermic element. The piezoelectric vibrator type recording head is further classified into two types: a first type of recording head using a piezoelectric vibrator displaced in the axial direction and a second type using a piezoelectric vibrator flexurally displaced. The first recording head can be driven at high speed and can record at high density, however, the manufacturing processes is complex because cutting work is required for machining a piezoelectric vibrator or three-dimensional assembly operations are required to fix the piezoelectric vibrator to a pressure generating chamber.

In contrast, the second type of recording head, provided with a pressure generating chamber and an actuator unit for pressurizing ink by a piezoelectric vibrator, can be formed by a ceramic baking technique, thus the manufacturing process is simpler than the manufacturing method of the first recording head. However, the whole recording head can become warped due to thermal stress. specifically, since a nozzle plate, for emitting ink pressurized by the actuator unit as an ink droplet, is formed by a metallic plate and the pressure generating chamber and actuator unit are formed by ceramic so that the recording head is constituted by integrating both via an adhesive layer, because of a difference in the coefficient of thermal expansion between ceramic and metal the head can warp. Warping may result in failure in emitting an ink droplet, and thus, deterioration of the printing quality.

To solve such problems, a thermal expansion characteristic adjusting member, having a section in the shape of reversed "C" and which does not prevent a piezoelectric vibrator from being vibrated, is fixed to the piezoelectric vibrator fixed to a surface of an actuator unit so as to prevent the whole recording head from being distorted because of a difference in thermal expansion as disclosed in Japanese published unexamined patent application No. H6-122197.

However, in such a recording head which uses a piezoelectric vibrator according to flexural oscillation, the area of the opening of a pressure generating chamber is larger to provide an adequate area for flexure, compared with a recording head using a piezoelectric vibrator in a longitudinal vibration mode. This has a problem that the recording density is deteriorated, compared with the first recording head.

To solve such a problem, a method has been adopted of using a silicon monocrystalline substrate for the base material, forming a passage such as a pressure generating chamber and a reservoir by anisotropic etching and forming a piezoelectric vibrator by film forming technique such as sputtering piezoelectric material. According to this method, an extremely thin elastic film can be formed and a pressure generating chamber and a piezoelectric vibrator can be formed precisely, so that the area of the opening of a pressure generating chamber can be minimized and recording density can be enhanced.

However, since the nozzle plate is still a metallic plate in order to maintain the machining precision of a nozzle aperture, there is a problem that the whole recording head is distorted because of the difference in thermal expansion as described above with respect to the second recording head in which a piezoelectric vibrator is fixed by baking. Such a problem can be solved by using a thermal expansion characteristic adjusting member disclosed in Japanese published unexamined patent application No. H6-122187; however, if a piezoelectric vibrator is constituted by sputtering piezoelectric material, a quantitatively higher electric field is applied in which the piezoelectric vibrator is thinner, compared with a piezoelectric vibrator constituted by baking a green sheet. If the above piezoelectric vibrators are driven at the same voltage, leakage current between driving electrodes increases and humidity in the atmosphere is absorbed and finally, dielectric breakdown is caused.

SUMMARY OF THE INVENTION

The present invention solves such problems by providing an ink jet recording head in which the distortion of a recording head due to a difference in the thermal expansion characteristic between materials constituting the recording head and the failure caused by changes in the external environment, such as humidity, and the operation of a piezoelectric vibrator formed by a film forming technique, are simultaneously solved.

A first embodiment of the present invention relates to an ink jet recording head provided with a passage forming substrate provided with a piezoelectric vibrator consisting of a diaphragm constituting a part of a pressure generating chamber communicating with a nozzle aperture, at least the upper surface of which acts as a lower electrode, and a piezoelectric active part consisting of a piezoelectric film formed on the surface of the diaphragm and an upper electrode formed on the surface of the piezoelectric film and formed in an area opposite to the pressure generating chamber. A cap member bonded on the side of the piezoelectric film of the passage forming substrate seals a space between the cap and pressure generating chamber so that the oscillation motion is not prevented and a dry fluid is sealed in the space of the cap member.

In such a first embodiment, since the piezoelectric vibrator is sealed off from the outside, the failure of the operation caused by the change of external environment is prevented.

DETAILED DESCRIPTION OF THE INVENTION

Figure 1:
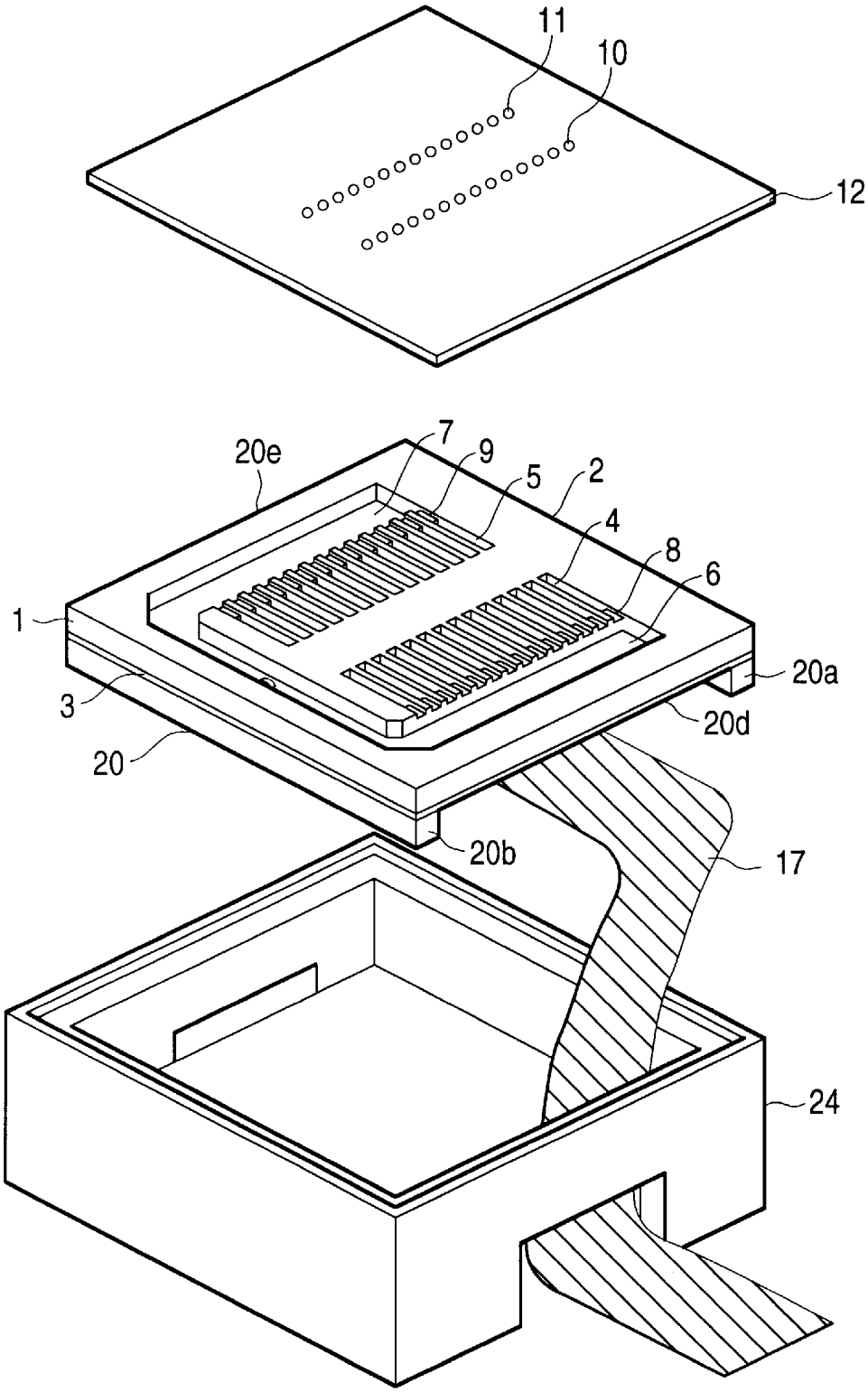
FIG. 1 is an exploded perspective view showing an ink jet recording head equivalent to an embodiment of the present invention.
Figure 2:
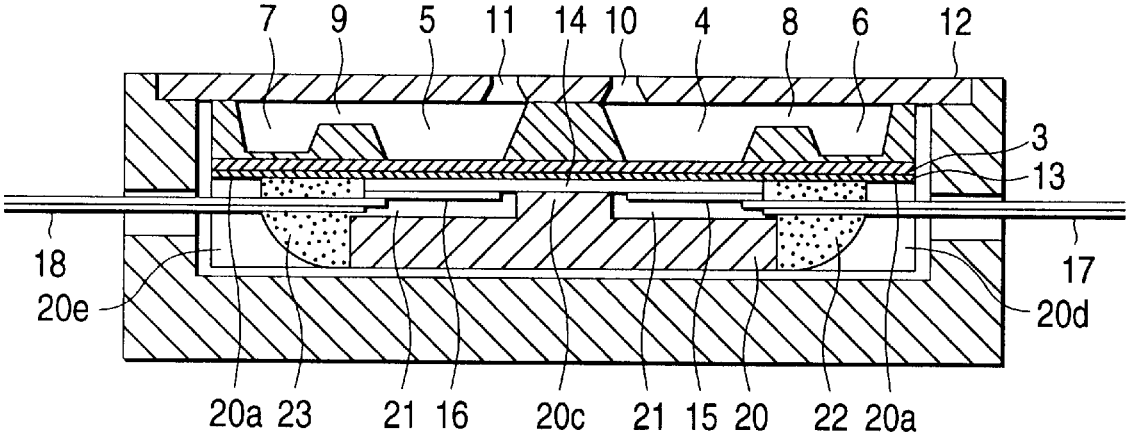
FIG. 2 is a sectional view showing the ink jet recording head equivalent to the embodiment of the present invention.

FIGS. 1 and 2 illustrate the first embodiment of the present invention. A passage forming substrate 1 having pressure generating chambers 4 and 5 formed in rows, two rows in this embodiment, reservoirs 6 and 7 for supplying ink to the pressure generating chambers 4 and 5 and ink supply ports 8 and 9 for making the pressure generating chambers 4 and 5 and the reservoirs 6 and 7 communicate at fixed fluid resistance, is formed by etching a silicon monocrystalline substrate so that one surface is an opening face 2 and an elastic film 3 of silicon oxide and the like is formed on the rear surface.

A nozzle plate 12 is fixed on the side of the opening face 2 via an adhesive layer and a deposited film. The nozzle plate 12 is made of a rustproof steel, or the like, in which nozzle apertures 10 and 11 are formed so that the nozzle apertures respectively communicate with one end of the pressure generating chambers 4 and 5.

Pressure generating means is provided for selectively expanding or contracting the pressure generating chambers 4 and 5. The pressure generating means is formed by a lower electrode 13 consisting of a metallic layer on the surface of the elastic film 3, a piezoelectric film 14 on the surface formed by a film forming method and upper electrodes 15 and 16 which respectively function as a segment electrode in the same location as each pressure generating chamber 4 or 5 on the surface of the piezoelectric film 14.

Flexible cables 17 and 18 are respectively connected to each of these lower electrode 13 and upper electrodes 15 and 16 so that the lower and upper electrodes receive a driving signal from an external driving circuit.

In an ink jet recording head unit as described above, a cap member 20 is provided with contact parts 20*a*, 20*b* and 20*c*. Contact parts 20*b* and 20*c* are at both ends of the cap member 20 along a direction in which the pressure generating chambers 4 and 5 are arrayed, and contact part 20*c* is formed in a center line area of the passage forming substrate 1 between the pressure generating chambers 4 and 5. The cap member is further provided with windows 20*d* and 20*e* for respectively leading the flexible cables 17 and 18 at each end. The cap member 20 is fixed directly to the passage forming substrate 1 or to the elastic film 3 or the piezoelectric film 14 by an adhesive and the like so that each space 21, to the extent that the motion of the pressure generating means is not prevented, is secured on the side of the piezoelectric film.

After inert gas, such as nitrogen and the like, is sealed in the space 21 formed by the cap member 20 and the passage forming substrate 1, molding agents 22 and 23 respectively seal the flexible cables 17 and 18 through the windows 20*d* and 20*e* and, thereby, a recording head is formed.

Figure 3:
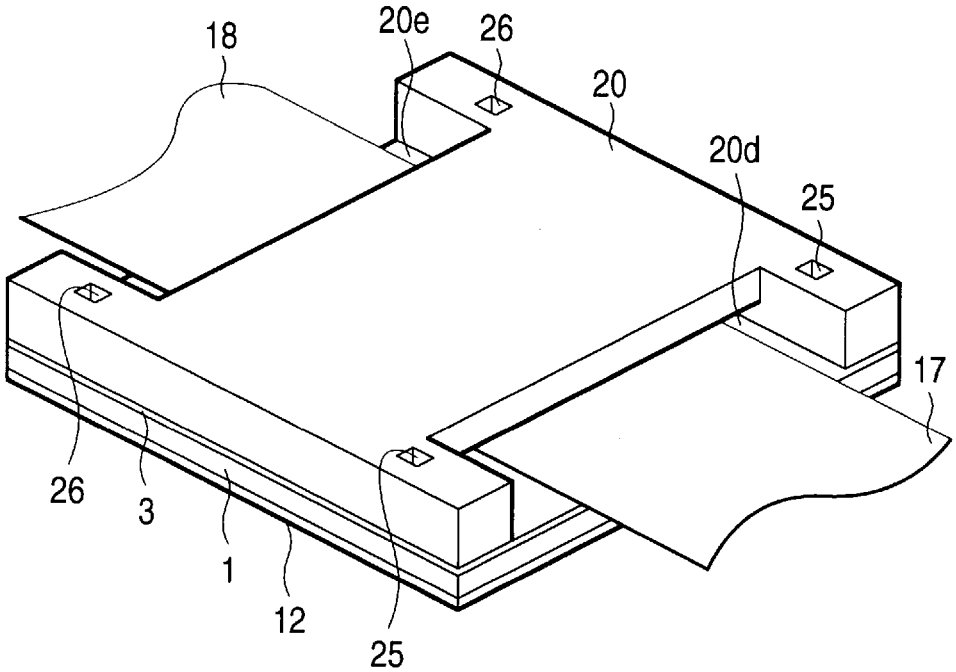
FIG. 3 shows the above recording head in a state before molding with a cap member on the upper side.
Figure 4:
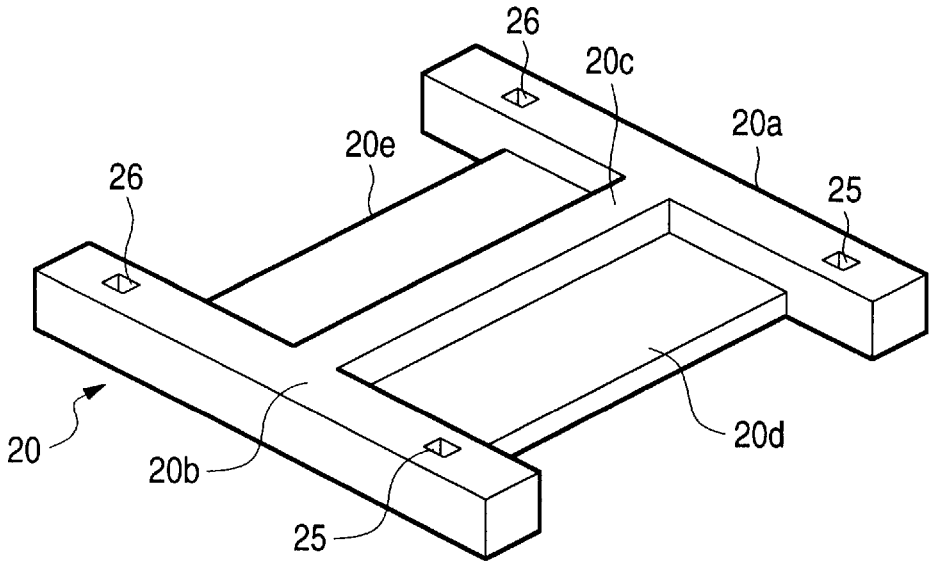
FIG. 4 shows an embodiment of the cap member of the above recording head with the surface which is in contact with the recording head on the upper side.

The recording head constituted as described above is housed in a holder 24 and attached to a carriage (not shown). As shown in FIGS. 3 and 4, ink intake ports 25 and 26 respectively supply ink to the reservoirs 6 and 7 from an ink tank outside (not shown).

As the piezoelectric film 14 is covered with inert gas, which is sealed in the space 21 formed by the cap member 20 and each molding agent 22 and 23, high insulation resistance can be provided without increasing leakage current between the lower electrode 13 and each upper electrode 15 or 16 independent of the change of relative humidity in external environment, so that the pressure generating chambers 4 and 5 are expanded or contracted by A fixed displacement quantity and printing quality can be maintained.

In the above embodiment, dry gas such as inert gas is injected into the space formed by the cap member and the head unit; however, even if silicone oil, in which moisture is not included, or insulating liquid, such as fluoric inactive liquid, are sealed, similar results are achieved.

For dry gas, reducing gas may be also used in addition to inert gas; however, conversely, oxidizing gas can be used to prevent the piezoelectric film from deteriorating. If such inert gas is used, it is desirable that the vapor pressure (partial pressure) of moisture in the inert gas is minimized.

A manufacturing method which uses dry gas (or dry fluid) is easiest; however, in consideration of a situation where a minute leak exists in the head, a manufacturing method using insulating liquid is preferable because the insulating liquid prevents moisture. The flexure is reduced if the viscosity of insulating liquid is high, therefore, it is desirable that the viscosity be kept to a minimum.

A second embodiment of the present invention relates to an ink jet recording head based upon the first embodiment and characterized in that the above fluid is inert gas.

Figure 5:
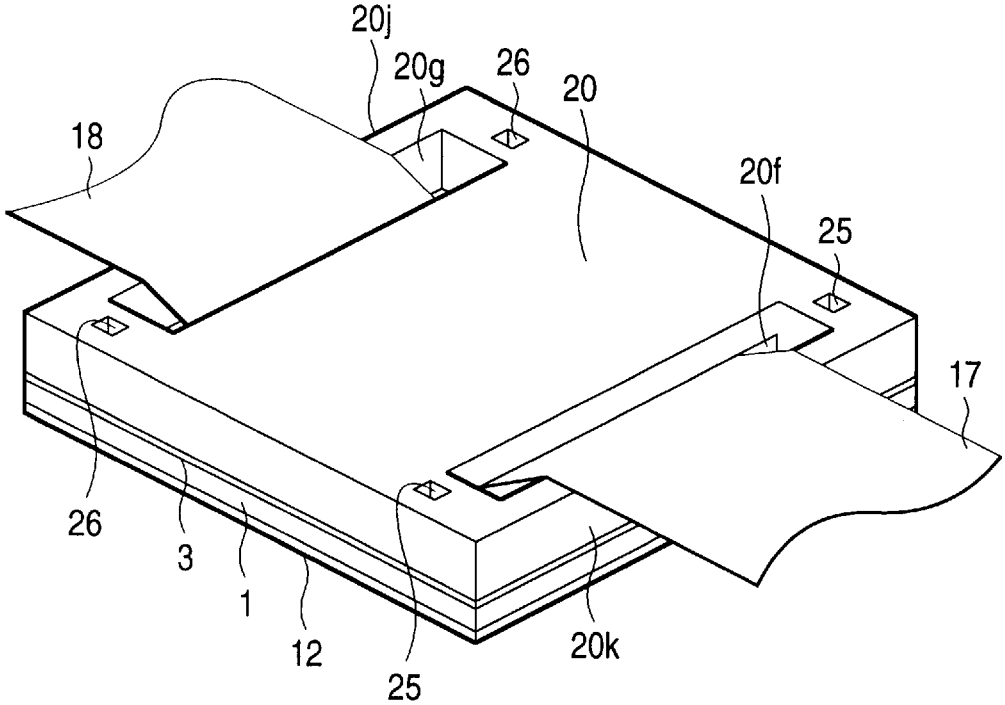
FIG. 5 shows an ink jet recording head equivalent to a second embodiment of the present invention in a state before molding with a cap member on the upper side.
Figure 6:
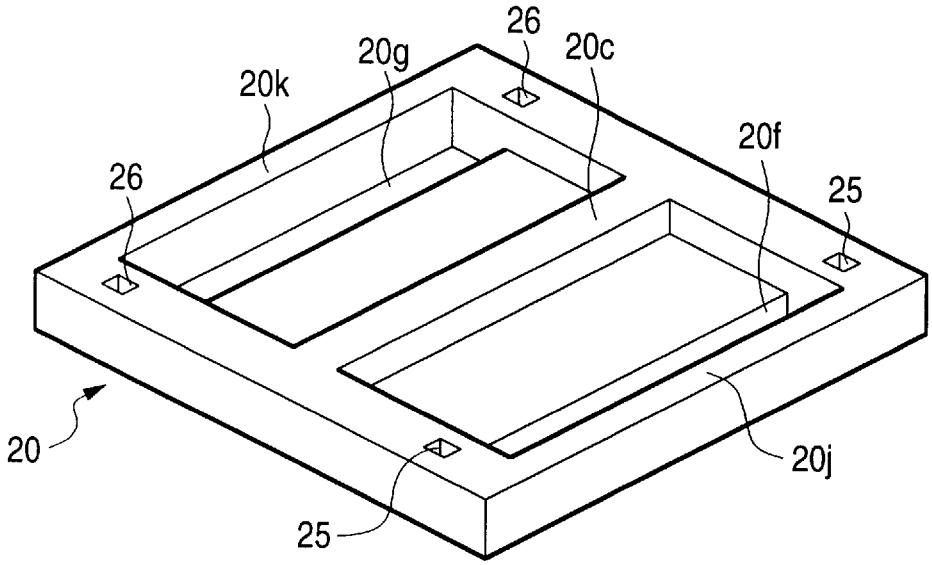
FIG. 6 shows the ink jet recording head equivalent to the second embodiment of the present invention with the surface of the cap member which is in contact with the recording head on the upper side.

FIGS. 5 and 6 show a cap member 20 equivalent to a second embodiment and this embodiment is the same as the first embodiment except that windows 20*f* and 20*g* are provided at each end of the cap member 20, for leading flexible cables 17 and 18 upward. The windows 20*f* and 20*g* are provided on the side of the cap 20 on which the flexible cables 17 and 18 are respectively led. In addition, contact surfaces 20*a*, 20*b* and 20*c* are formed at each end and at the center line as discussed above with regard to the first embodiment, and contact parts 20*j* and 20*k* are formed at each end where the flexible cables 17 and 18 are led from the windows 20*f* and 20*g*.

According to this embodiment, the cap member can be easily formed. The fringe and the center of a head unit can be reinforced by the cap member 20 and the passage forming substrate 1 and the nozzle plate 12 can be securely prevented from being warped.

In such a second embodiment, the active part of the piezoelectric vibrator is held in the atmosphere of inert gas and isolated from changes in the external environment.

A third embodiment of the present invention relates to an ink jet recording head based upon the first embodiment and characterized in that the above fluid includes oxidizing gas.

In such a third embodiment, a piezoelectric film mainly formed by an oxide is prevented from being deteriorated.

Figure 7:
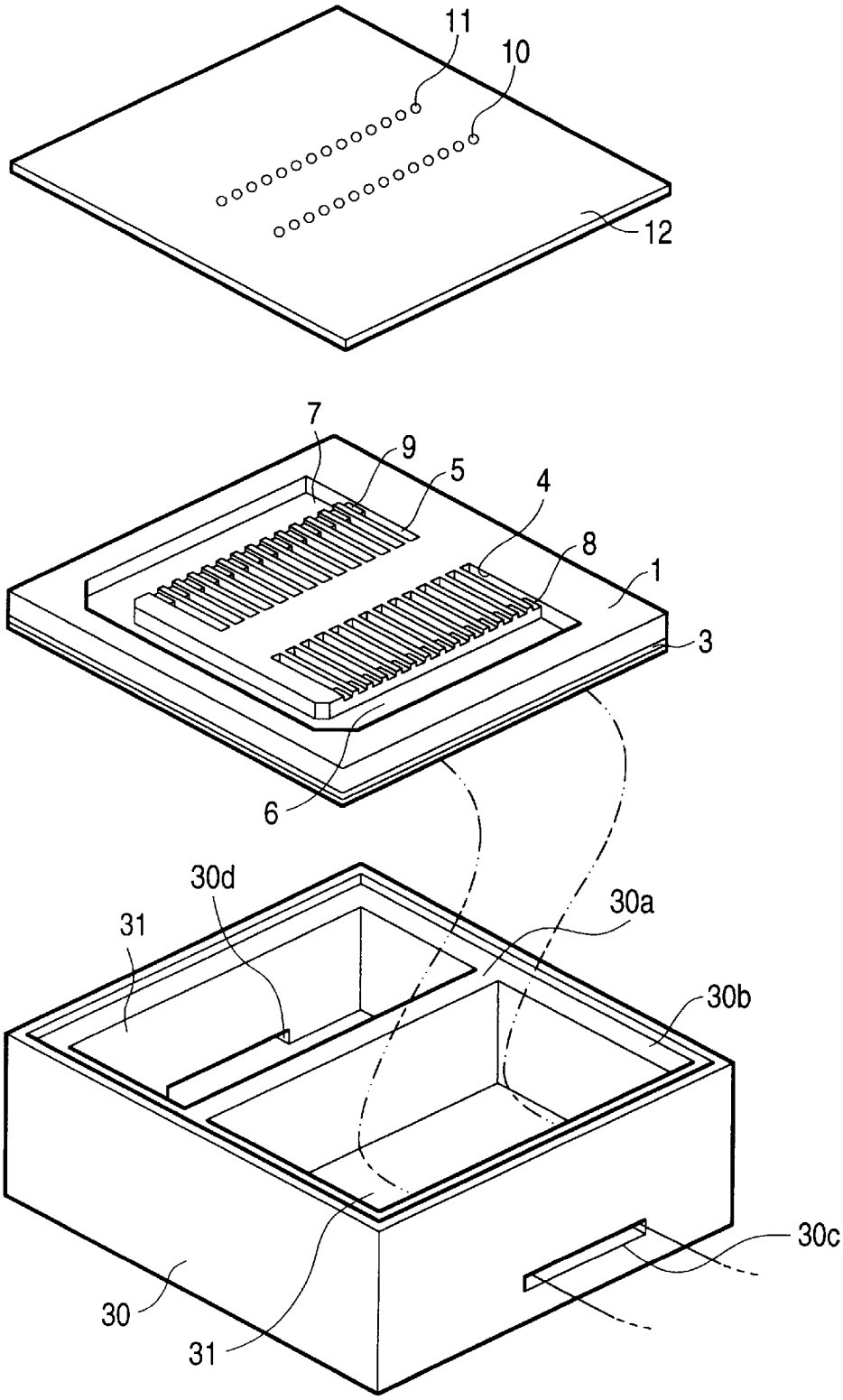
FIG. 7 is an exploded perspective view showing an ink jet recording head equivalent to a third embodiment of the present invention.

A holder 30 also functions as a cap member as shown in FIG. 7. The third embodiment is basically the same as the second embodiment except that a space 31 is formed inside the holder 30, and a contact part 30*a* which is in contact with a passage forming substrate 1 is provided in a center line area between pressure generating chambers 4 and 5. Also, windows 30*c* and 30*d* for leading a flexible cable 17 are provided near the lower end on both sides of the holder in a longitudinal direction of pressure generating chambers 8 and 9 and a peripheral wall 30*b* is provided for partitioning the space 31.

Therefore, the holder 30 is fixed directly to the passage forming substrate 1 or to an elastic film 3 or a lower electrode 13, via an adhesive or the like, at the peripheral wall 30*b* and the contact part 30*a*. After the space 31 formed by the holder 30 and the passage forming substrate 1 is filled with inert gas such as nitrogen, the windows 30*c* and 30*d* are sealed together with the flexible cable 17 by a molding agent or the like. The holder 30 is formed so that it is directly attached to a carriage of the recording apparatus (not shown).

The third embodiment provides the same advantages as the second embodiment; however, the holder 30 also functions as the cap member, so that the number of parts and processes can be reduced to lower the overall costs.

In the above embodiment, the window is provided for leading the flexible cable 17 through the holder; however, if the flexible cable 17 is thin enough, it can be led outside without providing the window, as discussed below with respect to the fourth embodiment.

A fourth embodiment of the present invention relates to an ink jet recording head based upon the first embodiment and characterized in that the above fluid is a fluid having lowered vapor pressure of water contained therein.

In such a fourth embodiment, the breakdown of the active part of the piezoelectric vibrator which is caused by moisture is prevented.

Figure 8:
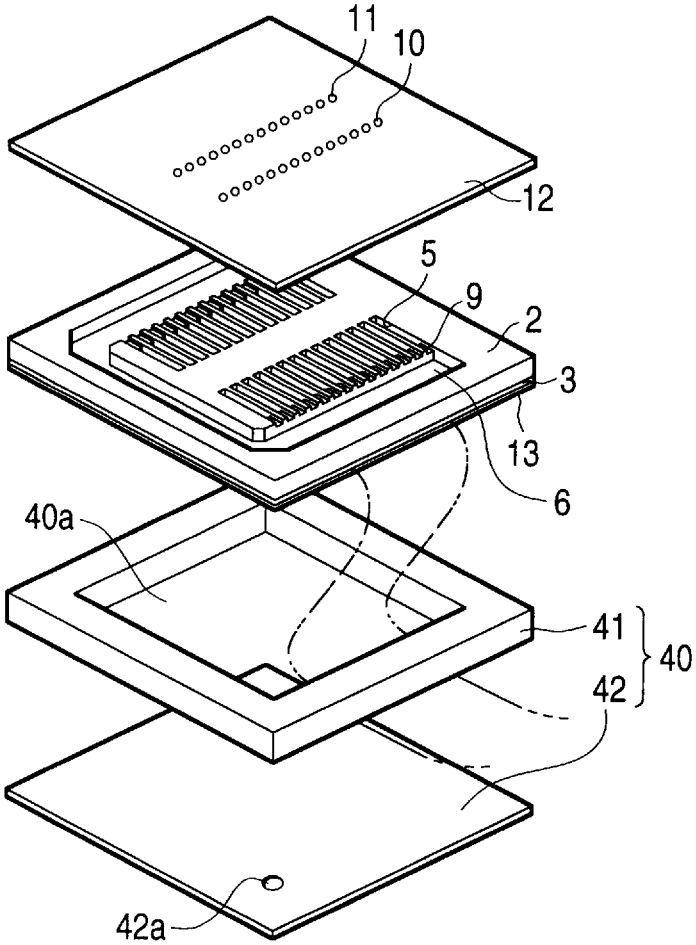
FIGS. 8(*a*) and 8(*b*) are an exploded perspective view and the sectional view respectively showing an ink jet recording head equivalent to a fourth embodiment of the present invention.
Figure 8:
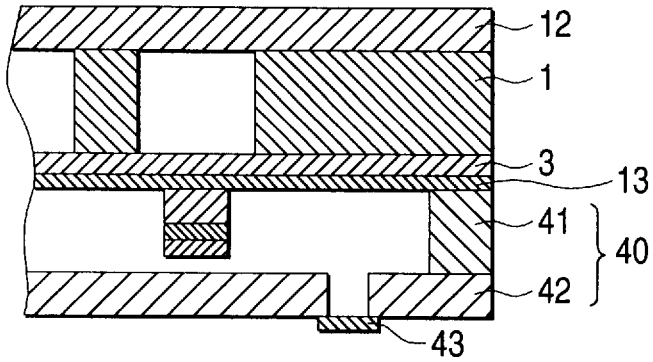

In the fourth embodiment, a cap member 40 includes a first cap member 41 having a through part 40*a* which provides a space. A second cap member 42 is provided for sealing the first cap member 41 as shown in FIGS. 8(*a*) and 8(*b*). The first cap member 41 and the second cap member 42 are bonded by an adhesive and the like and a flexible cable 17 is held between the first cap member 41 and the second cap member 42.

The fourth embodiment is basically the same as the second embodiment except that a gas replacing hole 42*a* for injecting inert gas and the like into a space formed by sealing the through part 40*a*, is provided to the second cap member 42. Inert gas and the like are injected through the gas replacing hole 42*a* and the gas replacing hole 42*a* is sealed by fixing a third cap member 43.

Therefore, according to this embodiment, the same advantages may be achieved as in the second embodiment and further, inert gas can be readily injected and sealed by simply sealing the gas replacing hole 42*a*.

In this embodiment, the gas replacing hole 42*a* is sealed by the cap member 43; however, the present invention is not limited to this arrangement and the gas replacing hole may be also sealed by other sealants such as an epoxy adhesive.

A fifth embodiment of the present invention relates to an ink jet recording head based upon the first embodiment and characterized in that the above fluid is insulating liquid.

In such a fifth embodiment, the piezoelectric active part is held in the atmosphere of insulating fluid and isolated from changes in the external environment.

Figure 9:
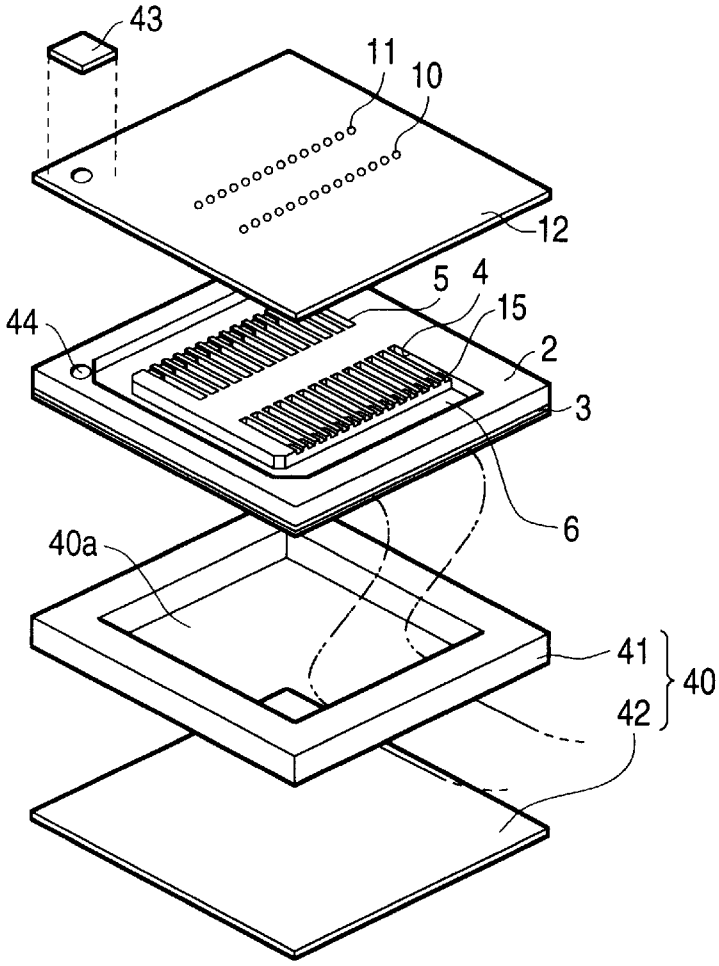
FIGS. 9(*a*) and 9(*b*) are an exploded perspective view and the sectional view respectively showing an ink jet recording head equivalent to a fifth embodiment of the present invention.
Figure 9:
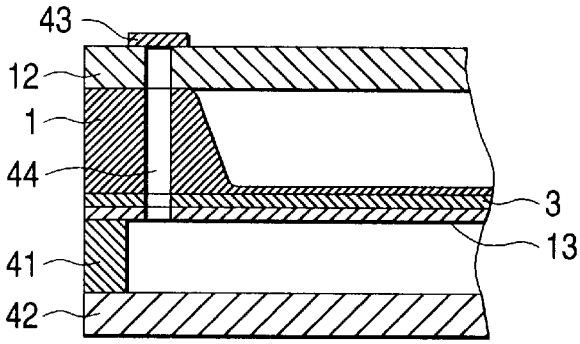

In the fifth embodiment, a gas replacing hole is not provided to the second cap member 42 as discussed above, but to a part of a passage forming substrate 1 in which an ink passage is not formed, for example to the peripheral part of reservoir 6 as shown in FIGS. 9(*a*) and 9(*b*). The fifth embodiment is the same as the fourth embodiment except that a communicating hole for connecting a lower electrode 13, an elastic film 3, the passage forming substrate 1 and the nozzle plate 12 is formed by a gas replacing passage 44 for connecting the interior space to the outside. Inert gas and the like can be injected from the side of the nozzle plate by adopting such a constitution.

A sixth embodiment of the present invention relates to an ink jet recording head based upon the fifth embodiment and characterized in that the above insulating liquid is silicone oil or fluoric inactive liquid.

In such a sixth embodiment, the piezoelectric active part is isolated from the outside by silicone oil or fluoric inactive liquid.

Figure 10:
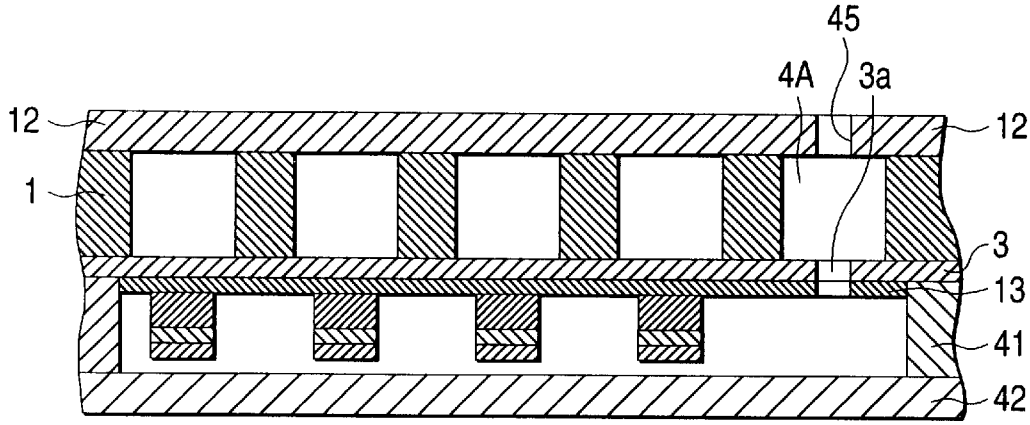
FIG. 10 is a sectional view showing the ink jet recording head equivalent to the fifth embodiment of the present invention.

The sixth embodiment is the same as the fourth embodiment except that one of the pressure generating chambers is a dummy pressure generating chamber 4A, located at one end of the row of pressure generating chambers as shown in FIG. 10. A through hole 3*a* is formed through the elastic film 3 and the lower electrode 13, and a gas replacing hole 45 communicating with the dummy pressure generating chamber 4A is provided at the nozzle plate 12.

A gas replacing passage can be formed without forming a special gas replacing passage with the above constitution.

A dummy piezoelectric active part may be also formed in an area opposite to the dummy pressure generating chamber 4A.

The embodiments of the present invention are described above, however, the basic constitution of the ink jet recording head is not limited to the above embodiments.

A seventh embodiment of the present invention relates to an ink jet recording head based upon any of the first to sixth embodiments and characterized in that the above cap member is provided with a gas replacing hole for sealing the above fluid in the above space and the gas replacing hole is sealed after the fluid is injected.

In such a seventh embodiment, the isolated atmosphere can be readily formed only by filling the fluid in the space from the side of the cap member and sealing the gas replacing hole.

An eighth embodiment of the present invention relates to an ink jet recording head based upon any of the first to sixth embodiments and characterized in that the above passage forming substrate is provided with a gas replacing hole for sealing the above fluid in the above space and the gas replacing hole is sealed after the fluid is injected.

In such an eighth embodiment, the fluid can be sealed from the side of the passage forming substrate.

A ninth embodiment of the present invention relates to an ink jet recording head based upon the eighth embodiment and characterized in that the above gas replacing hole of the above passage forming substrate uses a dummy pressure generating chamber formed together with the above pressure generating chamber.

In such a ninth embodiment, the gas replacing hole can be readily formed owing to the dummy pressure generating chamber.

A tenth embodiment of the present invention relates to an ink jet recording head based upon any of the first to sixth embodiments and characterized in that the above cap member is provided with an opening for leading a flexible cable for supplying a driving signal to the above piezoelectric vibrator and the opening is sealed after the above fluid is injected in the above space via the opening.

In such a tenth embodiment, sealed space can be readily formed using the flexible cable leading opening.

An eleventh embodiment of the present invention relates to an ink jet recording head based upon any of the seventh to tenth embodiments and characterized in that means for sealing the above space of the above cap member is an adhesive or a molding agent.

In such an eleventh embodiment, the sealed space can be readily formed by the adhesive or the molding agent.

A twelfth embodiment of the present invention relates to an ink jet recording head based upon any of the seventh to eleventh embodiments and characterized in that means for sealing the above space of the above cap member includes a cap member.

In such a twelfth embodiment, the sealed space can be readily formed by the cap member.

A thirteenth embodiment of the present invention relates to an ink jet recording head based upon any of the first to twelfth embodiments and characterized in that the above cap member is provided with structure reinforcing the above passage forming substrate by being bonded to the passage forming substrate.

In such a thirteenth embodiment, the passage forming substrate is reinforced by the cap member and the head can be prevented from being distorted.

A fourteenth embodiment of the present invention relates to an ink jet recording head based upon any of the first to thirteenth embodiments and characterized in that the above cap member and the above passage forming substrate are bonded via an adhesive layer and the adhesive layer is continuously provided from the bonded part to the inner surface of the cap member.

In such a fourteenth embodiment, moisture is prevented from invading from an interface between the cap member and the adhesive layer.

A fifteenth embodiment of the present invention relates to an ink jet recording head based upon any of the first to fourteenth embodiments and characterized in that the above cap member is a resin molding and the cap member and the above passage forming substrate are bonded via an adhesive layer provided with composition similar to the material of the resin molding.

In such a fifteenth embodiment, moisture is prevented from invading from an interface between the cap member and the adhesive layer.

A sixteenth embodiment of the present invention relates to an ink jet recording head based upon any of the first to fourteenth embodiments and characterized in that the above cap member is formed by transparent material.

In such a sixteenth embodiment, the displacement of the piezoelectric active part can be detected from the outside of the cap member using a laser beam, for example, and a driving test can be executed without filling ink.

A seventeenth embodiment of the present invention relates to an ink jet recording head based upon any of the first to sixteenth embodiments and characterized in that a boundary between a part of the above space sealed by the above cap member and the above pressure generating chamber is partitioned via the above diaphragm or the diaphragm a part in the direction of the thickness of which is removed, the thickness of the diaphragm or the diaphragm a part in the direction of the thickness of which is removed on the boundary is $2\times10^{-6}$ or less and the pressure generating chamber is filled with liquid including dye or pigment.

In such a seventeenth embodiment, the sealed space and an area filled with ink are separated via a thin film.

An eighteenth embodiment of the present invention relates to an ink jet recording head based upon any of the first to seventeenth embodiments and characterized in that the above pressure generating chamber is formed by applying anisotropic etching to a silicon monocrystalline substrate and each layer of the above piezoelectric vibrator is formed by a film forming method and lithography.

In such an eighteenth embodiment, the ink jet recording head provided with high density nozzle apertures can be manufactured in a large quantity and relatively easily.

A nineteenth embodiment of the present invention relates to an ink jet recording head based upon any of the first to eighteenth embodiments and characterized in that in the above passage forming substrate, a reservoir communicating with the above pressure generating chamber is formed and a nozzle plate provided with the above nozzle apertures is bonded to the passage forming substrate.

In such a nineteenth embodiment, the ink jet recording head for emitting ink from a nozzle aperture can be readily realized.

A twentieth embodiment of the present invention relates to an ink jet recording head based upon any of the first to eighteenth embodiments and characterized in that a passage unit in which a common ink chamber for supplying ink to the above pressure generating chamber and a passage connecting the pressure generating chamber and the above nozzle aperture are formed is bonded to the above passage forming substrate.

In such a twentieth embodiment, ink is emitted from a nozzle aperture via the passage unit.

Figure 11:
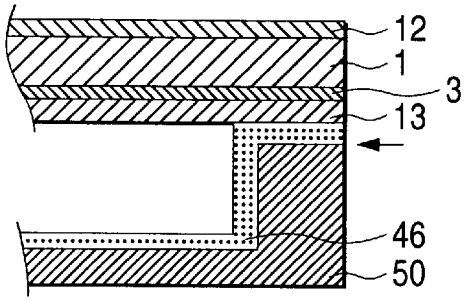
FIG. 11 is a partial sectional view showing an ink jet recording head equivalent to another embodiment of the present invention.

With respect to the above embodiments, the cap member and the passage forming substrate are bonded via an adhesive, however, at that time, as shown in FIG. 11, an adhesive layer 46 may be also be provided to the inner surface of a cap member 50. Hereby, moisture and others can be prevented from invading into space from an interface between the cap member 50 and the adhesive layer 46. In this case, it is most desirable that the adhesive layer is provided to the whole inner surface of the cap member 50; however, even if the adhesive layer is formed in less than the entire area of the inner surface, the advantageous effect is still achieved.

The material of a cap member is not particularly limited, for example, a cap member may be also formed by resin. In this case, it is desirable that the cap member and a passage forming substrate are bonded via an adhesive provided with composition similar to the material of the cap member. When the adhesive is hardened, the adhesive and the cap member are integrated and moisture can be prevented from passing an interface between the adhesive and the cap member.

Further, a cap member may be also formed by transparent material such as glass material and transparent resin. The quantity of the displacement of the pressure generating means can be measured using a laser beam and the like from the outside of the cap member. Thus, the emitted quantity can be checked readily without filling a pressure generating chamber with ink and emitting ink.

Further, in the above embodiments, the reservoirs 6 and 7 are formed together with the pressure generating chambers 4 and 5 in the passage forming substrate 1; however, a member for forming a common ink chamber may be also provided in the passage forming substrate 1.

Figure 12:
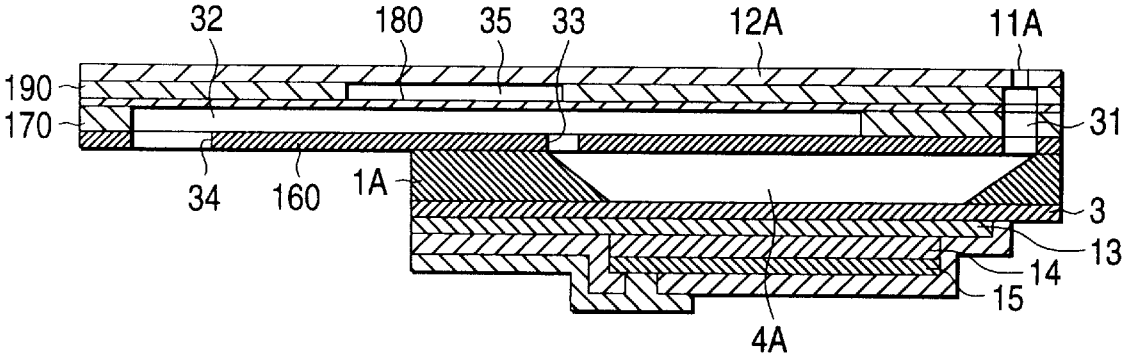
FIG. 12 is a partial sectional view showing an ink jet recording head equivalent to another embodiment of the present invention.

FIG. 12 shows the partial section of the ink jet recording head as described above. In this embodiment, a sealing plate 160, a common ink chamber forming plate 170, a thin plate 180 and an ink chamber side plate 190 are held between a nozzle substrate 12A and a passage forming substrate 1A. A port 31 communicates a pressure generating chamber 4A and a nozzle aperture 11A, arranged so that the port passes through the above plates. A common ink chamber 32 is partitioned by the sealing plate 160, the common ink chamber forming plate 170 and the thin plate 180, and each pressure generating chamber 4A and the common ink chamber 32 are connected via a hole 33 communicating with ink made in the sealing plate 160. An ink intake hole 34 for leading ink to the common ink chamber 32 from the outside is also made in the sealing plate 160. A through part 35 is formed in a position opposite to each common ink chamber 32 in the ink chamber side plate 190 located between the thin plate 180 and the nozzle substrate 12A so that pressure generated when an ink droplet is emitted and applied to the side reverse to the nozzle aperture 11A is absorbed by the thin wall 180 and thereby, unnecessary positive or negative pressure can be prevented from being applied to the other pressure generating chambers via the reservoir 32. The thin plate 180 and the reservoir side plate 190 may be also integrated.

In such embodiments, the piezoelectric active part can be readily cut off from the outside by fixing the above cap member to the surface of the passage forming substrate 1A reverse to the opening face and so that operational failure caused by the change of the external environment can be prevented.

In the above embodiments, as an example, the thin-type ink jet recording head which can be manufactured by applying film forming and lithographic processes is described, however, the present invention is not limited to this and the present invention can be applied to ink jet recording heads with various structures such as an ink jet recording head in which a pressure generating chamber is formed by laminating substrates, the one in which a piezoelectric film is formed by sticking a green sheet or by screen process printing and others and the one in which a piezoelectric film is formed by crystal growth.

As described above, according to the present invention, as a cap member for securing space to the extent that the motion of a piezoelectric active part is not prevented on the side of the piezoelectric active part is fixed to a passage forming substrate in an area not related to the vibration of the piezoelectric active part and the space is sealed by sealing dry fluid. The present invention thus prevents uneven stress generated between the passage forming substrate and a nozzle plate due to differences in thermal expansion and the passage forming substrate and the nozzle plate can be held as flat as possible. In addition, leakage current between electrodes is prevented from being increased due to the dry fluid in the space of the cap member and a molding agent independent of changes of relative humidity in the external environment, high insulation resistance is maintained and the element is prevented from breaking due to distortion.

What is claimed is:

1. An ink jet recording head comprising:

a passage forming substrate, constituting a pressure generating chamber;

a nozzle aperture communicating with said pressure generating chamber;

a pressure generating device comprising a lower electrode constituting at least a part of a vibration plate sealing said pressure generating chamber, a piezoelectric material formed on said lower electrode, and an upper electrode formed on a part of the piezoelectric material, said pressure generating device being arranged to correspond to said respective pressure generating chamber;

a cap member bonded on a part of the piezoelectric material so as to define a space above said upper electrode; and a desiccated fluid sealed in said space of said cap member.

2. An ink jet recording head according to claim 1, wherein said fluid is inert gas.

3. An ink jet recording head according to claim 1, wherein said fluid includes oxidizing gas.

4. An ink jet recording head according to claim 1, wherein said fluid is a fluid having lowered vapor pressure of water contained therein.

5. An ink jet recording head according to claim 1, wherein said fluid is insulating liquid.

6. An ink jet recording head according to claim 5, wherein said insulating liquid is silicone oil or fluoric inactive liquid.

7. An ink jet recording head according to any of claims 1 to 6, wherein said cap member is provided with a gas replacing hole for injected said fluid in said space and said gas replacing hole is sealed after said fluid is injected.

8. An ink jet recording head according to any of claims 1 to 6, wherein said passage forming substrate is provided with a gas replacing hole for injecting said fluid in said space and said gas replacing hole is sealed after said fluid is injected.

9. An ink jet recording head according to claim 8, wherein said gas replacing hole of said passage forming substrate uses a dummy pressure generating chamber formed together with said pressure generating chamber.

10. An ink jet recording head according to any of claims 1 to 6, wherein said cap member is provided with an opening for accommodating a flexible cable which supplies a driving signal to said piezoelectric material of said pressure generating device, and said opening is sealed after said fluid is injected in said space via said opening.

11. An ink jet recording head according to claim 7, wherein means for sealing said space of said cap member is an adhesive or a molding agent.

12. An ink jet recording head according to claim 7, wherein means for sealing said space of said cap member includes a cap member.

13. An ink jet recording head according to claim 1, wherein said cap member is provided with a structure for reinforcing said passage forming substrate by bonding to said passage forming substrate.

14. An ink jet recording head according to claim 1, wherein said cap member and said passage forming substrate are bonded via an adhesive layer, and said adhesive layer is continuously provided along the inner surface of said cap member.

15. An ink jet recording head according to claim 1, wherein said cap member is a resin molding, and said cap member and said passage forming substrate are bonded via an adhesive layer provided with composition similar to the material of said resin molding.

16. An ink jet recording head according to claim 1, wherein said cap member is formed by transparent material.

17. An ink jet recording head according to claim 1, wherein a boundary between a part of said space sealed by said cap member and said pressure generating chamber is partitioned via said passage forming substrate from which a part in the direction of the thickness of said passage forming substrate is removed;

the thickness of said passage forming substrate or said passage forming substrate from which a part in the direction of the thickness of said passage forming substrate is removed on said boundary is $2\times10^{-6}$ or less; and said pressure generating chamber is filled with liquid including dye or pigment.

18. An ink jet recording head according to claim 17, wherein said pressure generating device includes a piezoelectric vibrator having a plurality of layers, and wherein said pressure generating chamber is formed by applying anisotropic etching to a silicon monocrystalline substrate, and each layer of said piezoelectric vibrator is formed by a film forming method and lithography.

19. An ink jet recording head according to claim 1, further comprising a nozzle plate provided with nozzle apertures, and wherein said passage forming substrate includes a reservoir communicating with said pressure generating chamber, and said nozzle plate provided with said nozzle apertures is bonded to said passage forming substrate.

20. An ink jet recording head according to claim 1, wherein a passage unit, which includes a common ink chamber for supplying ink to said pressure generating chamber and a passage connecting said pressure generating chamber and said nozzle aperture, is bonded to said passage forming substrate.

21. An ink jet recording head according to claim 1, wherein an upper surface of said passage forming substrate operates as a lower electrode, and said pressure generating device comprises a piezoelectric film formed on the upper surface of said lower electrode of said passage forming substrate and an upper electrode formed on the upper surface of said piezoelectric film and formed in an area opposite to said pressure generating chamber.

* * * * *